US005839234A

United States Patent [19]

Mayer

[11] Patent Number: 5,839,234

[45] Date of Patent: Nov. 24, 1998

[54] WINDOW FRAMES

[76] Inventor: Howard E. Mayer, 209 Williamsburg Dr. #5, Thiensville, Wis. 53092

[21] Appl. No.: 610,483

[22] Filed: Mar. 4, 1996

[51] Int. Cl.[6] ..... E06B 3/54

[52] U.S. Cl. ..... 52/213; 52/207; 52/204.1; 52/204.5

[58] Field of Search ..... 52/207, 204.1, 52/213, 204.5

[56] References Cited

U.S. PATENT DOCUMENTS

| | | |
|---|---|---|
| 2,869,187 | 1/1959 | Liebman et al. . |
| 2,918,708 | 7/1959 | Sharp et al. . |
| 2,953,824 | 9/1960 | Minick . |
| 3,111,726 | 11/1963 | Grossman . |
| 3,324,597 | 6/1967 | Rich . |
| 3,420,026 | 1/1969 | Nolan . |
| 3,861,444 | 1/1975 | Portwood . |
| 4,004,629 | 1/1977 | Kelly . |
| 4,544,770 | 10/1985 | Anders . |
| 4,674,246 | 6/1987 | Giguere . |
| 5,265,388 | 11/1993 | Sherwood . |

FOREIGN PATENT DOCUMENTS

| | | |
|---|---|---|
| 222834 | 1/1957 | Australia . |
| 1420069 | of 0000 | France . |

*Primary Examiner*—Carl D. Friedman
*Assistant Examiner*—Beth Aubrey
*Attorney, Agent, or Firm*—James D. Welch

[57] ABSTRACT

The present invention provides improved window frames and window frame systems for containing slideably mounted window sash systems. The present invention includes guides in upper horizontally oriented window frame heads which are of different depths on left and right horizontal sides, so that window sash systems present can-be slid into a closed position under a shallower guide means wherein they can not be pried upward. The improved window frames and window frame systems can provide self contained wall trim, provide structural integrity, provide improved thermal control, and are easy to install by a convenient, described method. A prefered present invention window frame is of single piece construction and is fabricated by a resin transfer process.

29 Claims, 2 Drawing Sheets

WINDOW FRAMES

TECHNICAL FIELD

The present invention relates to window frames, and more particularly to inner and outer window frames for containing slideably mounted window sash systems, each of which inner and outer window frames are of single piece construction formed by a resin transfer molding procedure. The present invention provides improved window frame systems for containing slideably mounted window sash systems, which improved window frame systems provides self contained wall trim, structural integrity, inherently provide thermal control, and are easy to install.

BACKGROUND

The use of window frames and sashes in houses and buildings is well known. Typical construction of early window frames was from wood, but attendant therewith were the problems of dry rot, warping an swelling. In an attempt to overcome such drawbacks inventors covered wood used in the construction of window frames with thin plastic extrusions. Such thin plastic extrusions served to delay warping and swelling, but actually tended to accelerate dry rot. A major advance was made with the introduction of aluminum window frames in that window frames made of aluminum are compact, and do not exhibit swelling, warping and dry rot, however, new problems presented. Said problems being sweating and associated high thermal conductivity. Attempts to overcome said sweating and high thermal conductivity problems included constructing window frames in which aluminum was utilized, wherein aluminum components were separated by thermally insulating wood. Another technique utilized plastic rails placed between aluminum elements. Such use of plastic led to fabricating window frames entirely therefrom. Plastic, however, is not a rigid as aluminum, hence, plastic extruded window frames tended to be bulky to provide sufficient strength. While the appearance of such bulky Window Frames is less than optimum, however, it should be appreciated that plastic has the benefit of not requiring periodic painting. It is noted at this point that present invention Window Frames are produced by a resin transfer molding process, and comprise a more attractive, less bulky result, which incorporates thermal control and provides self contained wall trim, thereby enhancing ease of installation.

A Search of Patent in the area has provided a Patent to Andars, U.S. Pat. No. 4,554,770. This Patent describes the use of small plastic buffers to reduce heat transfer in hollow aluminum frames. A primary purpose of the construction is to avoid gaps through which air might enter. A seal is provided between adjacent sashes by a separate removable intermediate interlocking rail.

Another Patent, to Gigeure, U.S. Pat. No. 4,674,246 describes a sliding window frame having two or more removable sash mounted therein, said window frame having head and sill made of thermally insulating plastic.

A French Patent to Armstadt, No. 1,420,069 describes a single glazed window in an aluminum frame without thermal breaks.

U.S. Pat. No. 3,324,597 to Rich describes a pair of window sash, one fixed and one slidable, with the two sash having leading edge interlocking weather strip flanges which may be interlocked on either side of the sash. The design focused on use in large size systems. Considerable separate finishing trim would apparently be required with the described system in practice.

A Patent to Nolan, U.S. Pat. No. 3,420,026 is disclosed as it describes an aluminum frame with thermal breaks. The focus is upon the use of thermal insulation to prevent or reduce condensation problems associated with metal frame windows or the like.

Another Patent, U.S. Pat. No. 3,111,726 to Grossman, describes window construction incorporating a horizontally slidable inner sash and an outer sash which is fixed. The frame involved is of multiple piece construction.

A Patent, U.S. Pat. No. 2,953,824 to Minick describes a system relating to window construction of the type including one or more fixed sash panels and one or more horizontally sliding sash panels all contained and supported within a frame in which all component sections (head, sill and side bar), are formed from extruded structural members.

U.S. Pat. No. 2,953,824 to Sharp describes a corner joint structure for application in sliding closure systems comprising a means for interconnecting a pair of frame members.

A Patent to Liebman et al, U.S. Pat. No. 2,869,187 describes a sliding type window construction of comprising a metal frame.

A Patent to Vogelhut, Australian No. 222,834, describes a sliding door construction comprised of aluminum door panels, head, jamb and sill members.

U.S. Pat. No. 4,004,629 to Kelly describes a frameless sliding window assembly comprising a pair of jambs a header and a sill which are constructed from only two simple extruded shapes.

U.S. Pa. No. 3,861,444 to Portwood describes an extruded plastic window frame fabricated from extruded plastic components which are cut to length according to a given window size.

Finally, a Patent to Sherwood, U.S. Pat. No. 5,265,388 is disclosed as it describes a window frame assembly for mounting a window pane to a building. The outside and inside single piece construction frames each comprise radial projections which extend over outside and inside walls respectively. However, the window involved is not mounted in a slidable sash.

No known Patent provides for, at once, in the presence of slideably mounted window sash systems, single piece inner and single piece outer window frame construction, each of which inner and outer window frames provide self contained wall trim, and which inner and outer window frames, when combined into a window frame system, provide the benefits of thermal control, structural integrity, and ease of installation. Previously known window frames for containing slidable window sash systems have jambs, heads and sills which are constructed from extrusions, thereby requiring various corner structures to provide structural integrity.

There remains need for an improved window frame system for containing slideably mounted window sash systems, which improved window frame system provides self contained trim, thermal control and ease of installation.

DISCLOSURE OF THE INVENTION

The present invention provides a window frame system comprised of present invention inner and outer window frames, each of which present invention inner and outer window frames is of a single piece construction. There are two primary embodiments of the inside (outside) window frame, one which is similar to the outside (inside) window frame in that it includes window sash system guide means for slideably containing window sash systems, and one which does not provide window sash system guide means for slideably containing window sash systems. Typically inner and outer window sash systems, which both include window sash system guide means for slideably containing window sash systems, will be applied to buildings and houses or the like, the walls of which are formed from two (2) by six (6) materials, (ie. which are six (6) inches deep). The end result is a highly insulating double window sash system. However, in walls of buildings or houses or the like which are constructed from two (2) by four (4) materials, (eg. the wall is approximately four (4) inches deep), typically only one the present window frames will provide window sash system guide means for slideably containing window sash systems. This is because there is not sufficient wall depth room present to include two present invention window frames which each provide window sash system guide means for slideably containing window sash systems. In a modified embodiment, however, both present invention inner and outer window frames applied to a wall constructed from two (2) by four (4) inch materials can provide means for slideably containing window sash systems. In said modified embodiment a portion of at least one, (ie. a present invention inner or outer window frame), will extend beyond the surface plane of an inner or outer building or house or the like wall.

It is to be appreciated that the present invention allows a user to install a present invention outer window frame, and then while still accessible, (ie. prior to installing a mating inside present invention window frame), apply foam insulation therearound. This is not possible in combined inner and outer single piece window frame systems. Also, both inside and outside present invention window frames include elements for effecting slideable mating between facing analogically similar points of said inner and outer window frames which make simultaneous contact with one another when mounted in a building or house or the like. Said slideable mating taking place at a central location within said wall. By using separate inner and outer window frames, it is possible to position each with respect to the another so that projecting trim, which is present on each is of the inner and outer present invention window frames, is simultaneously flush with the wall, (ie. inside or outside respectively), to which it is mounted. A prefabricated single piece window frame can not provide this adjustment in the field. As well, as the present invention inner and outer window frames are each made independently, by a resin transfer molding process, the molding for each is simpler than for a single combined inner and outer single piece window frame system. Benefits enabled by a two piece present invention window frame system are then:

a. provision of the ability to apply insulating foam around a first installed present window frame while access thereto is still available (eg. prior to installation of the other present invention window frame);

b. provision of the ability to slideably adjust the distance between installed present invention inner and outer window frames, (to compensate for specific wall depth present), so that trim on each is flush against inner and outer wall surfaces respectively, when installation is complete; and c. ease in fabrication.

As mentioned the present invention is primarily a window frame of a single piece construction, which, as viewed in frontal elevation comprises vertically oriented Right and Left Jambs, a generally horizontally oriented Bottom Sill and a horizontally oriented Top Head. The generally horizontally oriented window frame Bottom Sill has a first and a second lower window sash system guide means extending essentially the horizontally oriented length of an upward facing surface of said generally horizontally oriented Bottom Sill, and the horizontally oriented Top Head has a first and a second upper window sash system guide means extending essentially the horizontally oriented length of a downward facing surface of said horizontally oriented Top Head. Said first and second upper window sash system guide means extend upward into said downward facing surface of said horizontally oriented Top Head to first and second depths, with a change in said depth occurring approximately half way along the horizontally oriented length of said Top Head. The first upper window sash system guide being shallower than the second one on one horizontally oriented side, and with said second upper window sash system guide means being shallower than said first upper window sash system guide means on the other horizontally oriented side. In use a window sash system can be caused to be horizontally slideably retained within Bottom Sill and Top Head corresponding first window sash system guide means and simultaneously a second window sash system can be caused to be horizontally slideably retained within Bottom Sill and Top Head corresponding Second window sash system guide means. When said window frame is affixed to a building wall and window sash systems are present within each corresponding horizontally oriented first and second lower and upper window sash system guide means respectively, each of said window sash systems can be placed in a closed window sash system position wherein each said window sash system is positioned below the shallower Top Head contained upper window sash system guide means such that said window sash systems can not be pried upward. As well, each window sash system can slide horizontally so as to be placed in an open position beneath the deeper upper Top Head contained window sash system guide means. Said present invention window frame also comprises mating elements located thereon such that when said window frame is installed on a side of said wall selected from the group consisting of inner and outer side of a wall of a building, mating elements on facing analogically similar points of another window frame of similar size and shape mounted on a side of said wall selected from the group consisting of outer and inner respectively, can make slideable contact with said mating elements.

The present invention window frame vertically oriented Jamb adjacent to a shallower Top Head contained upper window sash system guide means typically has therein a window sash system edge receiving means, such than when a window sash system present in said window frame is placed in a closed window sash system position, an edge thereof adjacent to said window sash system edge receiving means is caused to be present therein. This occurs simultaneous with an upper edge of said window sash system being present within said shallower of the Top Head contained upper window sash system guide means and with a lower edge of said window sash system being present within said Bottom Sill contained lower window sash system guide means. It is noted that to effect a smooth uncluttered appearance in present invention window frames, similar window sash system receiving means are not present in said window frame adjacent to deeper Top Head contained window sash system contained upper window sash system guide means.

For the purposes of effecting improved insulation capability, a ridge which projects from a centrally facing surface in said window sash system edge receiving means can be provided, said ridge being comprised of a material which provides insulating contact between said window sash system edge receiving means and a window sash system contained edge.

It is noted that in a present invention window frame of single piece construction the shallower upper window sash system guide means can be located on the right or left side thereof, as said window frame is viewed in frontal elevation when said inner and outer window frames are mounted in a wall of said building.

Further, it is to be appreciated that the first and second lower window sash system guide means are preferably arrow-head shaped and lower edges window sash systems placed into said first and second window sash system guide means have a complimentary inverted "V" shape which slideably mates therewith in use said arrow head shape can be effected by an aluminum insert, or be effected as an integral part of the window frame.

While not a limitation, the first and second upper window sash system guide means can be arcuate shaped as viewed in side cross-sectional elevation, such that when a window sash system with an arcuate shaped upper edge placed thereinto, is caused to be positioned beneath a deeper upper window sash system guide means, said window sash system can be lifted upward into said deeper window sash system guide means so that a lower edge of said window sash system is caused to be removed from a corresponding lower window sash system guide means. When said window sash system, so positioned, is then caused to be rotated about a longitudinal axis defined by the horizontally upper edge of said window sash system present within said deeper upper window sash system guide means, removal of said window sash system from said window frame can be achieved.

A present invention window frame of single piece construction, can further comprise trim extending therefrom such that when said window frame is mounted to a building wall and viewed in frontal elevation, said trim extends over a portion of a wall in directions surrounding said inner window frame selected from the group consisting of right and left horizontal and up and down vertical.

As well, a present invention window frame can further comprises locking means for securing window sash systems in a closed window sash system position.

An important aspect of present invention window frames is that said generally horizontally oriented Bottom Sill can present with a downward slope as viewed in side elevation, such that when said window frame is mounted to an outside wall of a building or house or the like, rain water falling thereonto will run off thereof away from said wall. In addition, a present invention Window Frame can present with both horizontal and downward sloping portions.

It is also to be appreciated that a present invention window Frame can further comprise screen receiving means for containing a screen therein in use.

As alluded to infra, it is to be understood that a present invention window frame of a single piece construction need not be fitted with window sash guide means. Hence a present invention window frame can, as viewed in frontal elevation comprise vertically oriented Right and Left Jambs, a generally horizontally oriented Bottom Sill and a horizontally oriented Top Head, in combination with trim extending therefrom such that when said window frame is mounted to a building wall and viewed in frontal elevation, said trim extends over a portion of a wall in directions surrounding said inner window frame selected from the group consisting of right and left horizontal and up and down vertical. Such a present invention window frame will also comprise mating elements located thereon such that when said window frame is installed on a side of said wall selected from the group consisting of inner and outer side of a wall of a building, mating elements on facing analogically similar points of another window frame of similar size and shape mounted on a side of said wall selected from the group consisting of outer and inner respectively, can make slideable contact with said mating elements. Said embodiment can also comprise screen receiving means.

With the basic structures of individual present invention window frames now described, it is to be understood that a window frame system for containing window sash systems will comprise two window frames, termed inner and outer window frames, where each of said inner and outer window frames is of a single piece construction. In use said outer window frame is mounted to a building wall with window sash systems mounted therein, if present, positioned so as to contact at least an environment outside the building, and such that window sash systems mounted within said inner window frame, if present, are positioned so as to contact at least an environment inside said building. (Note that a present invention window frame need not contain window sash systems as described infra, hence window sash systems need not be present in both inner and outer present invention window frames). Continuing, said present invention inner and outer window frames are of similar sizes and shapes, so that when installed in a wall of a building, mating elements on facing analogically similar points of said inner and outer window frames can make simultaneous slideable contact with one another. As viewed in frontal elevation when mounted to a building wall, each present invention inner and outer window frame comprises vertically oriented Right and Left Jambs, a generally horizontally oriented Bottom Sill and a horizontally oriented Top Head. At least one of which generally horizontally oriented inner and outer window frame Bottom Sills has a first and a second lower window sash system guide means extending essentially the horizontally oriented length of an upward facing surface of the said at least one generally horizontally oriented Bottom Sill, and the horizontally oriented Top Head of said at least one of said inner and outer window frames has a first and a second upper window sash system guide means extending essentially the horizontally oriented length of a downward facing surface of said horizontally oriented top Heads, which first and second upper window sash system guide means extend upward into said downward facing surface of said horizontally oriented Top Head of said at least one of said inner and outer window frames, to first and second depths. A change in said depth occurring approximately half way along the horizontally oriented length of said at least one Top Head. Said first upper window sash system guide means is shallower than the second one on one horizontally oriented side, and said second upper window sash system guide means is shallower than said first upper window sash system guide on the other horizontally oriented side. In use a window sash system can be caused to be horizontally slideably retained within said horizontally oriented Bottom Sill and Top Head corresponding First window sash system guide means in said at least one of the inner and outer window frames. Simultaneously another window sash system can be caused to be horizontally slideably retained within horizontally oriented Bottom Sill and Top Head corresponding Second window sash system guide means in said at least one of the inner and outer window frames. When said inner and outer window frames are affixed to a building wall and window sash systems are present within said at least one of said inner and outer frames corresponding horizontally oriented first and second lower and first and second upper window sash system guide means respectively, each of said window sash systems can be placed in a closed window sash system position wherein each said window sash system is positioned below the shallower horizontally oriented Top Head contained upper window sash system guide means such that said window sash systems can not be pried upward. As well, each window sash system can slide horizontally so as to be placed in an open position beneath the deeper upper horizontally oriented Top Head contained window sash system guide means.

A present invention window frame system as described can include, in a vertically oriented Jamb adjacent to a shallower Top Head contained upper window sash system guide means, in said at least one of the inner and outer window frames, a window sash system edge receiving means. When such a window sash system present in said at least one window frame is placed in a closed window sash system position, an edge thereof adjacent to said window sash system edge receiving means is caused to be present therein, simultaneous with an upper edge of said window sash system being present within said shallower of the Top Head contained upper window sash system guide means and with a lower edge of said window sash system being present within said Bottom Sill contained lower window sash system guide means. As well, it is typical that similar window sash system receiving means are not present elsewhere in either of said inner and outer window frames.

It is again noted that, for insulation purposes, a ridge can be present which projects from a centrally facing surface in said window sash system edge receiving means, said ridge being comprised of a material which provides insulating contact between said window sash system edge receiving means and a contained window sash system edge.

The present invention window frame system shallower upper window sash system guide means in said at least one of the inner and outer window frames can be located on the right or left side thereof, as said window frames are viewed from the inside of a building in frontal elevation when said inner and outer window frames are mounted in a wall of said building.

Where a present invention window frame system contains window sash systems in both inner and outer window frames, the shallower upper window sash system guide means in the inner and outer window frames are located on opposite sides thereof, as said window frames are viewed from the inside of a building in frontal elevation when said inner and outer window frames are mounted in a wall of said building.

It is again noted that in a present invention window frame system the first and second lower window sash system guide means in said at least one of the inner and outer window frames are typically arrow-head shaped, and lower edges of window sash systems placed into said first and second window sash system guide means in each of the inner and outer window frames have a complimentary inverted "V" shape which slideably mates therewith in use. Said arrow head shape can be effected by an aluminum insert or be effected as an integral part of the window frame.

As mentioned infra, a present invention window frame system first and second upper window sash system guide means in said at least one of said inner and outer window frames can be arcuate shaped as viewed in side cross-sectional elevation, such that when a window sash system with an arcuate shaped upper edge placed thereinto, is caused to be positioned beneath a deeper upper window sash system guide means, said window sash system can be lifted upward into said deeper window sash system guide means so that a lower edge of said window sash system is caused to be removed from a corresponding lower window sash system guide means. When said window sash system is then caused to be rotated about a longitudinal axis defined by the horizontally upper edge of said window sash system present within said deeper upper window sash system guide means, removal of said window sash system from said window frame can be achieved.

Both inner and outer present invention window frame systems can further comprises trim extending therefrom such that when said inner frame is mounted to a building wall and viewed from the inside of the wall providing building, said trim extends over a portion of an inside wall in directions surrounding said inner window frame selected from the group consisting of right and left horizontal and up and down vertical. As well, when said outer window frame is mounted to a building wall and viewed from the outside of the wall providing building, said trim extends over a portion of said outside wall in directions surrounding said outer window frame selected from the group consisting of right and left horizontal and up and down vertical.

It is to be understood that both inner and outer window frames are preferably formed by resin transfer molding. It is to be noted that resin transfer molding comprises an injection process in which a resin which is compounded to be free flowing is forced into a die under low pressure. The hardening of said resin is catalized by heat, rather than by chemicals. As applied in the present invention, said resin transfer molding allows for strength enhancing focused curing of the corners of a present invention window frame. Molds for injecting separate inner and outer present invention window frames, it is noted, are much simpler than molds required for one-piece window frames wherein the inner and outer window frames constitute a single piece.

The present invention will be better understood by reference to the Detailed Description Section of this Disclosure, in conjunction with the accompanying Drawings.

SUMMARY OF THE INVENTION

It is therefore a purpose of the present invention to provide single piece window frames which provide structural integrity, especially at corners.

It is another purpose of the present invention to provide window frames which provide trim as an integral part thereof.

It is yet another purpose of the present invention to provide window frames which can be mounted to outside and to inside walls of a building or house and the like, which outside and inside mounting window frames are essentially mirror images of one another in important respects.

It is still yet another purpose of the present invention to provide window frames which do not appear bulky, but rather have a clean smooth appearance with only necessary window sash receiving and guide means present therein.

It is yet still another purpose of the present invention to provide window frames which allow window sash system means mounted therein to be removed only when said window sash system means are in open positions.

It is another purpose of the present invention to provide window sash system receiving means shaped as arrow heads.

It is yet another purpose of the present invention to provide outer window frames for application to outside walls of buildings and houses and the like which provide downward sloping sills for the purpose of effecting water flow off-thereof in use.

It is yet still another purpose of the present invention to provide outer window frames with downward sloping sills which have different length lower window sash system guide means present, such that two window sash systems present therein are of the same general size.

It is still yet another purpose of the present invention to teach a method of installation of the system thereof, which allows easy application of foam insulation around an outer window frame, prior to installation of an inner window frame.

DETAILED DISCLOSURE

Figure 1:
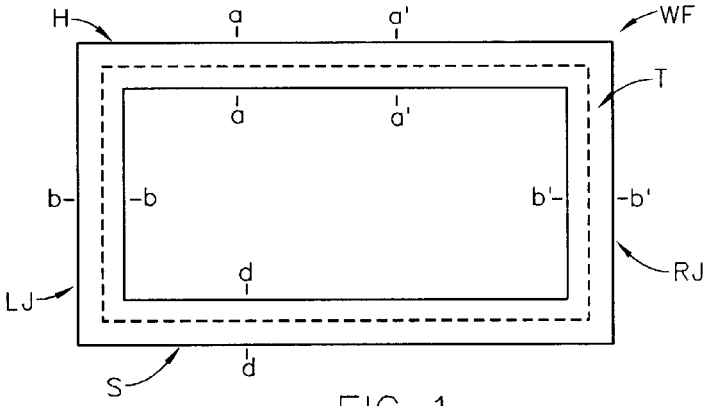
FIG. 1 demonstrates a single piece present invention window frame in frontal elevation.
Figure 3:
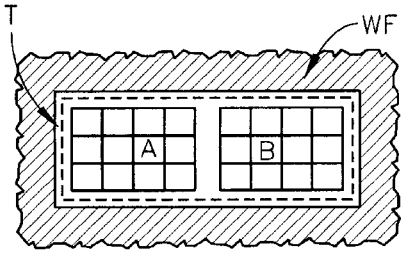
FIG. 3 shows a present invention window frame with left and right positioned window sash systems mounted therein.

Turning now to the drawings, there is demonstrated in FIG. 1 a present invention Window Frame (WF), of single-piece construction, as viewed in frontal elevation. Note that said present invention Window Frame (WF) is typically generally rectangular in shape, with an upper horizontally oriented positioned Head (H), a lower positioned generally horizontally oriented Bottom Sill (S), and a vertically oriented Left Jamb (LJ) and vertically oriented Right Jamb (RJ) present. A dotted line is present in each of the (H), (S), (RJ) and (LJ) to represent the integral presence of trim (T) which in use projects over a wall to which said present invention Window Frame (WF) is mounted in use. FIG. 3 shows a present invention Window Frame with Left (A) and Right (B) positioned Window Sash Systems present therein, and mounted to a Wall (W). In use at least one of said Left (A) and Right (B) positioned Window Sash Systems can be caused to slide easily to an opposite (ie. Right and Left respectively), side position. In one of said positions said Left (A) and Right (B) positioned Window Sash Systems will be in a "Closed" Position, (see supra), and in the others in an "Open" Position.

Figure 2A:
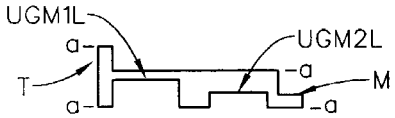
FIGS. 2*a* through 2*j* show cross-sectional views taken at identified locations in FIG. 1, all of which are observed from the right or top of FIG. 1.
Figure 2B:
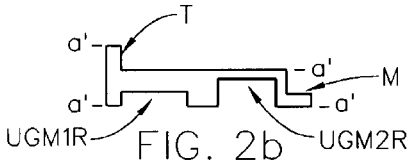
Figure 2C:
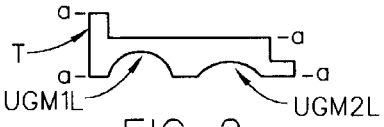
Figure 2D:
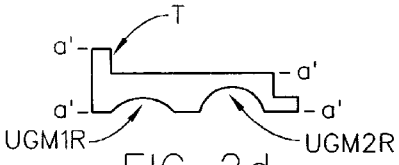

Note that in FIG. 1, designation of location for a number of cross-sectional views is provided. FIGS. 2*a* through 2*j* show said corresponding cross-sectional views, taken from the Right or Top in FIG. 1, at appropriate indicated locations thereon. Note that FIGS. 2*a* and 2*c* are taken in the Head (H) at the left side (a—a) of the present invention Window Frame as viewed in frontal elevation in FIG. 1, and that FIGS. 2*b* and 2*d* are taken in the Head (H) on the right side (a'—a') thereof. FIGS. 2*a* and 2*c* show that on the left side of the present invention Window Frame Head (H), Upper Window Sash System Guide Means (UGM1L) extend deeper into the downward facing surface of the Head (H) than do the shallower Upper Window Sash System Guide Means (UGM2L), but that on the Right side thereof Upper Window Sash System Guide Means (UGM2R) extends deeper into the downward facing surface of the Head (H) than do the shallower Upper Window Sash System Guide Means (UGM1L). FIGS. 2*a* & 2*c* show different embodiments of the shape of said Left Upper Window Sash System Guide Means, and FIGS. 2*b* & 2*d* show different embodiments of the shape of said Right Upper Window Sash System Guide Means. The reasons that an Upper Window Sash System Guide Means extends deeper into a downward facing surface of said Head (H) is that in use, when a Window Sash System is present in a Window Sash Guide Means it is desirable to be able to secure said Window Sash System in a "Closed" position in which said Window Sash System can not be pried upward, but it is also desirable to be able to remove such a present Window Sash System when desired. Thus, when a Window Sash System is caused to be placed beneath a shallower Window Sash System Guide Means, it can be secured in a "Closed" Position, while when placed beneath a deeper Window Sash System Guide Means (an "Open" Position), it can be forced upward and caused to be removed from said present invention Window Frame (WF). The "Arcuate" shapes of said Window Sash System Guide Means shown in FIGS. 2*c* and 2*d* are desirable, but not limiting, and aide with the ease of Window Sash System removal by allowing the upper edge of a Window Sash System to effectively rotate within when urged to do so by a user. (Note that forcing a Window Sash System upward allows it to become free of lower Window Sash System Guide Means positioned in a Window Frame Bottom Sill).

Figure 2E:
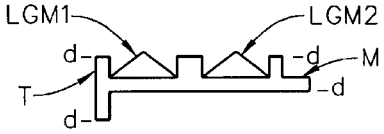
Figure 2F:
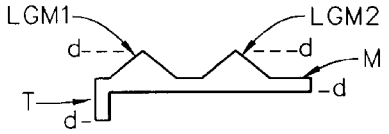
Figure 2G:
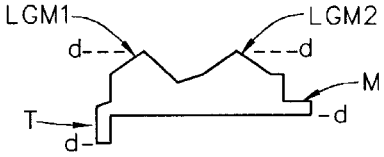
Figure 2G:
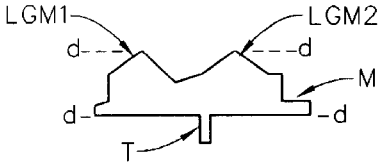

Turning now to FIGS. 2*e* through 2*gb,* there are shown various embodiments of Bottom Sill (S) contained Lower Window Sash System Guide Means (LGM1) and (LGM2). Note that in each case a (LGM1) or (LGM2) has an arrow head shape. In FIG. 2*e* the arrow head shape is formed by an insert which rests in a depression in an upward facing surface of said Sill (S). In this case the insert will typically be made of aluminum. It is found that Window Sash Systems which have a mating inverted "V" shape in their lower edge slide over such an aluminum insert very well in use. FIGS. 2*f*, 2*ga,* and 2*gb* however, show that the arrowhead shapes can be formed as an integral part of the Bottom Sill (S). FIG. 2*e* will typically correspond to a present invention Inner Window Frame, while the profile in FIGS. 2*ga* and 2*gb* will correspond to a present invention Outer Window Frame. The sloped profile in FIGS. 2*ga* and 2*gb* is beneficial to encouraging rain water to run off thereof in use. (Note that FIG. 2*gb* shows Trim (T) positioned so as to meet a Wall of a Building or House or the like with a portion of said represented Wall Frame extending out therebeyond. This allows positioning two Window Sash Systems in such a present invention Window Frame in a Building or House or the like in which a Wall (W) is not sufficiently deep to account for the depth of said present invention Window Frame. It is also to be understood that Trim (T) in Left and Right Jambs and Top Head would be similarly situated. The location of Trim (T) can then vary in the present invention Window Frame as demonstrated without exceeding the scope of the present invention).

Figure 2H:
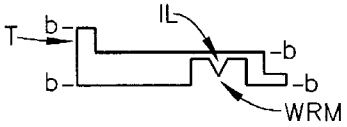
Figure 2I:
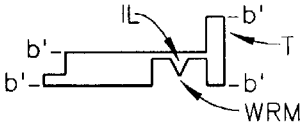

FIGS. 2*h* and 2*i* show that Left (LJ) and Right (RJ) Jambs can have Window Sash System Receiving Means (WRM) therein, positioned so as to be able to receive an edge of a Window Sash System, ("A" or "B") in use, when said Window Sash System is positioned in said present invention Window Frame in a "Closed" Position, (that is, an upper edge of such a Window Sash System is placed under a shallower Upper Window Sash System Guide Means such as ((UGM2L) or (UGM2R)). A projecting Ridge (I) can also be in the Window Sash System Receiving Means (WRM) present to act as an Convection Insulator Means. Said projecting Ridge (I) is typically made of a compressible material. Note that similar Window Sash Receiving Means are not present in a Jamb adjacent to a deeper Upper Window Sash System Guide Means. This serve to provide a smoother, uncluttered appearance to a present invention window frame.

Figure 2J:
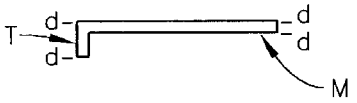

FIG. 2*j* shows an embodiment of a present window frame which does not provide means for slideably retaining a window sash system. Typically such a present invention window frame will be utilized as an inner window frame, with an outer window frame which provides means for slideably retaining window sash systems, such as represented by FIGS. 1 through 2*ga*. The FIG. 2*j* embodiment will typically be utilized in the case that a wall is constructed from two (2) by four (4) materials, and there is not sufficient wall "depth" present to allow both inner and outer present invention window frames to contain window sash systems. However, note that the configuration of FIG. 2*gb,* which involves a window frame which extends beyond the plane of a wall to which it is mounted, can be utilized in a wall constructed from two (2) by four (4) materials.

Figure 4:
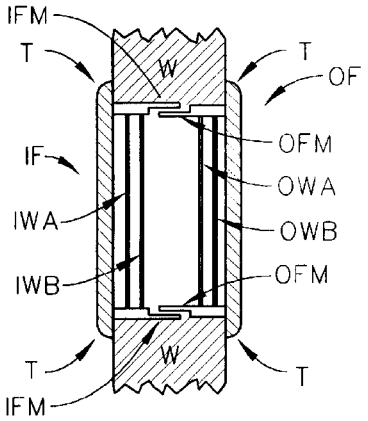
FIG. 4 shows two present invention window frames, (inner and outer), each of single piece construction mounted to the inside, and to the outside respectively of a wall of a building. Facing, analogically similar, portions of said frames being oriented so as to mate with one another.
Figure 5A:
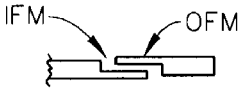
FIGS. 5*a* and 5*b* show an expanded view of mating portions of two present invention window frames as shown in FIG. 4.
Figure 5B:
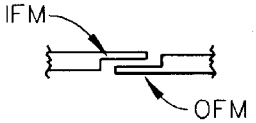

Turning now to FIG. 4, there are demonstrated, in cross-sectional side elevation, Inner (IF) and Outer (OF) Window Frames, as mounted to a Wall (W) of a building. Shown are Inner Window Sash Systems (IWA) and (IWB) and Outer Window Sash Systems (OWA) and (OWB) present respectively in said Inner (IF) and Outer (OF) present invention Window Frames. FIGS. 5*a* and 5*b* demonstrate that in use facing analogically similar points of Inner (IF) and Outer (OF) present invention Window Frames, are slideably interconnected by Mating Elements (IFM) and (OFM) respectively, (note (IFM) and (OFM) are also shown in FIG. 4), slide together to provide a complete present invention Window Frame System, mounted in Wall (W). It will be noted in FIGS. 6*a* and 7*a,* (see supra), that it is preferable to utilize the configuration of FIG. 5*b,* as during installation, foam insulation (FI), (see FIGS. 6*a* through 7*b*), will typically be applied around the Outer Window Frame (OF) and will block access to a Mating Element (IFM) on Inner Window Frame (IF) once it hardens. However, if an Inner Window Frame (IF) can be installed while said Foam Insulation (FI) is still soft, a firm bonding of the Inner and Outer Window Frames can be effected thereby, where the configuration of FIG. 5*a*, as demonstrated in FIG. 4, is utilized.

Figure 6A:
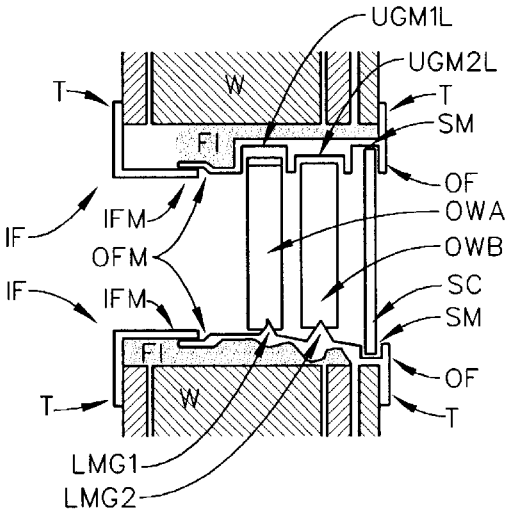
FIGS. 6*a* and 6*b* show front elevational cross-section, and top cross-sectional views of a present invention window frame system in which only an outer window frame contains window sash systems.
Figure 6B:
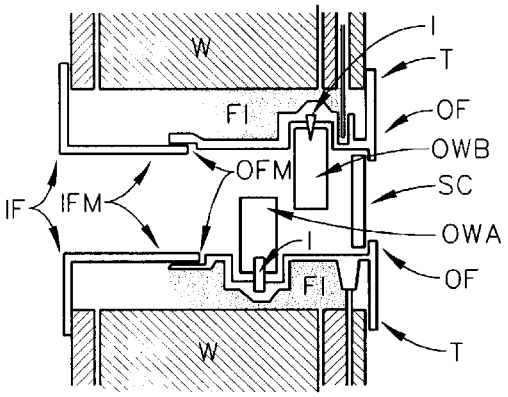

Turning now to FIGS. 6*a* and 6*b*, there are shown side elevational and top cross sectional views of a present invention Window Frame System in which only the Outer Window Frame (OF) contains Window Sash Systems (OWA) & (OWB). The Inner Window Frame (IF) is shown to comprise Trim (T) and Mating Elements (IFM), whereas Outer Window Frame (OF) is shown to additionally comprise First and Second Upper Guide Means (shown are (UGM1L) & (UGM2L), and First and Second Lower Guide Means (LMG1) & (LMG2), with Outer Window Sash Systems (OWA) & (OWB) present therein respectively. Shown as well are Screen Retaining Means (SM) with a Screen (SC) present therein. Note that Mating elements (IFM) and (OFM) of the Inner and Outer present invention Window Frames (IF) & (OF) are shown to slideably contact one another at a location within the region between the outer and inner planes of the outer and inner wall surfaces where the Trim (T) makes contact therewith. (Note that Mating Elements were generally shown as (M) in FIGS. 2*a* through 2*j*). This slideable contact between Mating Elements ((IFM) & (OFM) allows easy adjustment of Inner (IF) and Outer (OF) Window Frames during installation so that Trim (T) on each can be simultaneously positioned flush to said Inner and Outer Wall Surfaces as shown.

Figure 7A:
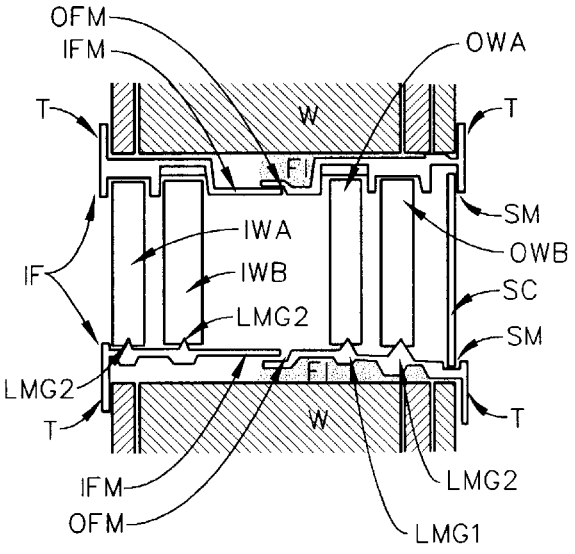
FIGS. 7*a* and 7*b* show front elevational cross-section, and top cross-sectional views of a present invention window frame system in which both inner and outer window frames contains window sash systems.

It is also noted, by reference to FIGS. 6*a,* 7*a* and 2*ga* and 2*gb,* that the First and Second Lower Guide Means (LMG1) & (LMG2) are of different vertical projecting lengths, and that Outer Window Sash Systems (OWA) & (OWB) are both of the same overall size. This use of different First and Second Lower Guide Means (LMG1) & (LMG2) lenghts to allow both Outer Window Sash Systems (OWA) & (OWB) to be of the same vertical height is believed to be novel. As well, FIGS. 6*a* and 7*a* show that the Mating elements (IFM) and (OFM) of the Inner and Outer present invention Window Frames (IF) & (OF) which slideably contact one another at a location within the region between the outer and inner planes of the outer and inner wall surfaces, can be extended beyon what is shown in FIGS. 2*ga* and 2*gb,* and be of slightly different shape. Said extention provides a relatively horizontal portion, in addition to a downward sloping section, as viewed in cross-section. This configuration can be termed a "Partially Downward Sloping" embodiment of the Outer Window Frame.

Figure 7B:
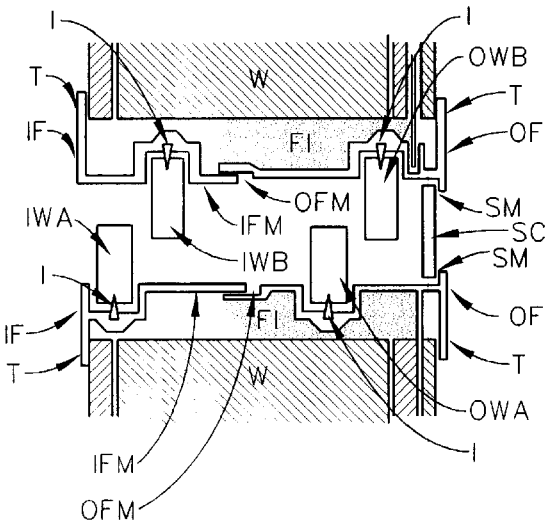

Turning now to FIGS. 7*a* and 7*b* there are shown side elevational and top cross sectional views respectively of a present invention window frame system much as were shown in FIGS. 6*a* and 6*b*, but with said Inner Window Frame (IF) also providing means for containing Window Sash Systems (IWA) & (IWB). Other than the presence of an Inner Window Frame (IF) which supports the presence of Window Sash Systems (IWA) & (IWB), FIGS. 7*a* and 7*b* are essentially the same as FIGS. 6*a* and 6*b*. It is to be noted that the configuration of FIGS. 6*a* and 6*b* will typically be utilized where a Wall (WE) is of two (2) by four (4) inch construction, but that the configuration of FIGS. 7*a* and 7*b* will be applied where a Wall (W) is of two (2) by six (6) inch construction.

It is to be understood that present invention Inner and Outer Window Frames can have different depths which are selected to match specific Building Wall requirements. For instance, a Building Wall which is only four (4) inches thick, will require a present invention Outside Window Frame which provides outward projecting depth, (such as demonstrated by FIG. 2*gb*), sufficient to allow the presence of two window Sash Systems therein, (it such is desired), while simultaneously allowing Trim to contact the outer surface of said Building Wall. A six inch deep Building Wall will require a somewhat different present invention Outer Window Frame Trim configuration, as demonstrated by FIG. 2*ga*. Use of an Inner Window Frame (IWF) as demonstrated in FIG. 2*j,* however, can be used in a four (4) inch deep wall, as shown in FIG. 6*a*. It is to be noted, however, that in any of said variations, that the basics of the present invention Window Frames as described above remain unchanged.

It is also to be noted that FIGS. 6*a* and 7*a* show Window Frame Cross-Sectionals much as demonstrated by FIG. 2*ga,* in which the Bottom Sill is generally horizontally oriented, but presents with a downward slope in said Cross-Section.

The Cross-Section in FIGS. 6*a* and 7*a* being observed from a left side in FIG. 1, however.

It is also to be noted that Foam Insulation (FI), (indicated as a multiplicity of dots), is shown present around the Outer Window Frame (OF) in FIGS. 6*a* through 7*b*. It is to be appreciated that the installation Procedure allows for easy application thereof after said Outer Window Frame (OF) is in place, but prior to placing Inner Window Frame (IF) into place. This provides a much better insulating result than is achieved by use of Glass Wool or other Compressible Insulation, as is generally used in conventional practice. This method of installation provides great utility, and is a method of use of the present invention. In more detail said method comprises the steps of providing a present invention Outer Window Frame System, installing it in a wall of a building or house or the like, applying insulating foam therearound, and installing a present invention Inner Window Frame.

It is to be generally understood that a present invention Window Frame is of Single-Piece construction, preferably being the result of a resin transfer molding process in which a heat catalized resin is forced into a mold and then exposed to heat. It is particularly important to understand that said process allows fabrication of structurally sound One-Piece present invention Window Frames, which demonstrate high corner strength, without the necessity that said present invention Window Frames be bulky.

Finally, in use, said present invention Window Frames (IF) & (OF) will be typically mounted to a building or house or the like, (assumed equivalent for the purposes of this Disclosure), by nails or screws, with the Outer Window Frame (OF) also secured in place with injected expandable foam.

Having hereby disclosed the subject matter of the present invention, it should be obvious that many modifications, substitutions, and variations of the present invention are possible in light thereof. It is therefore to be understood that the present invention can be practiced other than as specifically described, and should be limited in breadth and scope only by the Claims.

I claim:

1. A window frame system for containing window sash systems, said window frame system comprising:

inner and outer window frames;

each of said inner and outer window frames, as viewed in frontal elevation, comprising:

vertically oriented right and left jambs;

a generally horizontally oriented bottom sill; and a horizontally oriented top head;

each of said vertically oriented right and left jambs having a lower portion at a vertically lower extent thereof, and an upper portion at a vertically upper extent thereof;

each of said generally horizontally oriented bottom sill and said horizontally oriented top head having a horizontally oriented length with a right portion at a right horizontal extent thereof and a left portion at a left horizontal extent thereof; with said horizontally oriented top head horizontally oriented length having one horizontally oriented side on a selection from the group consisting of to the right and to the left of an essential center point of said horizontally oriented length thereof, and an opposite horizontally oriented side respectively selected from the group consisting of to the left and to the right of said essential center point of said horizontally oriented length thereof;

wherein, for each of said inner and outer window frames, the right and left portions of said generally horizontally oriented bottom sill and of said horizontally oriented top head are continuous with said vertically oriented right and left jambs at: the lower and upper portions of said right and left jambs, respectively;

wherein the generally horizontally oriented bottom sill of said inner window frame has an upward facing surface and wherein the horizontally oriented top head of said inner window frame has a downward facing surface; and wherein the generally horizontally oriented bottom sill of said outer window frame has an upward facing surface and wherein the horizontally oriented top head of said outer window frame has a downward facing surface;

and wherein, for each of said inner and outer window frames, the upward facing surface of the generally horizontally oriented bottom sill thereof directly faces the downward facing surface of the horizontally oriented top head thereof;

said inner and outer window frames being of similar sizes and shapes;

at least one of said inner and outer window frames having first and second lower window sash system guide means extending essentially the entire horizontally oriented length of the upward facing surface of the generally horizontally oriented bottom sill thereof, and said horizontally oriented top head of said at least one of said inner and outer window frames having first and second upper window sash system guide means extending essentially the entire horizontally oriented length of the downward facing surface thereof, each of said first and second upper window sash system guide means extending upward into said downward facing surface of said horizontally oriented top head of said at least one of said inner and outer window frames to first and second depths, with a change in said depth occurring approximately half-way along the horizontally oriented length of said horizontally oriented top head in said at least one of said inner and outer window frames, with said first upper window sash system guide means being shallower than the second on one horizontally oriented side, and with said second upper window sash system guide means being shallower than said first upper window sash system guide means on the opposite horizontally oriented side;

such that in use a first window sash system can be horizontally slideably retained within said generally horizontally oriented bottom sill and said horizontally oriented top head corresponding first window sash system guide means in said at least one of the inner and outer window frames, and such that simultaneously a second window sash system can be horizontally slideably retained within said generally horizontally oriented bottom sill and said horizontally oriented top head corresponding second window sash system guide means in said at least one of the inner and outer window frames;

such that said inner and outer window frames can be affixed to a building wall and first and second window sash systems placed within said at least one of said inner and outer window frames, between corresponding horizontally oriented first upper and first lower, and second upper and second lower window sash system guide means respectively, so that each of said first and second window sash systems can be placed in a closed window sash system position wherein each of said first and second window sash systems can be positioned below the shallower side of one of the horizontally oriented top head contained upper window sash system guide means, such that said first and second window sash systems can not be pried upward, and such that each of said first and second window sash systems can slide horizontally so as to be placed in an open position beneath the deeper side of one of the upper horizontally oriented top head contained window sash system guide means.

2. A window frame system for containing window sash systems as in claim 1, in which the vertically oriented jamb adjacent to at least one of the shallower horizontally oriented top head contained upper window sash system guide means in said at least one of the inner and outer window frames has therein:

window sash system edge receiving means, such than when a window sash system in said at least one window frame is placed in the closed window sash system position, an edge of said window sash system adjacent to said window sash system edge receiving means can be received in said window sash system edge receiving means, simultaneous with an upper edge of said window sash system being adapted to being received within said shallower side of the horizontally oriented top head contained upper window sash system guide means.

3. A window frame system for containing window sash systems as in claim 2 in which a ridge projects from a centrally facing surface in said window sash system edge receiving means, said ridge being comprised of a material which is adapted to provide insulating contact between said window sash system edge receiving means and the contained window sash system edge.

4. A window frame system for containing window sash systems as in claim 1 in which the shallower side of the upper window sash system guide means in said at least one of the inner and outer window frames is located on the right side thereof, as said at least one window frame is viewed from the inside of the building in frontal elevation when said at least one window frame is mounted in a wall of said building.

5. A window frame system for containing window sash systems as in claim 1 in which the shallower side of the upper window sash system guide means in said at least one of the inner and outer window frames is located on the left side thereof, as said at least one window frame is viewed from the inside of the building in frontal elevation when said at least one window frame is mounted in a wall of said building.

6. A window frame system for containing window sash systems as in claim 1 in which both inner and outer window frames have first and second upper and lower window sash system guide means therein and both inner and outer window frames are adapted to have window sash systems therein, such that the shallower upper window sash system guide means in the inner and outer window frames are located on horizontally opposite sides, as said window frames are viewed from the inside of the building in frontal elevation when said inner and outer window frames are mounted in a wall of said building.

7. A window frame system for containing window sash systems as in claim 1 in which the first and second lower window sash system guide means in said at least one of the inner and outer window frames are arrow-head shaped and lower edges of the window sash systems placed into said first and second window sash system guide means in each of the inner and outer window frames have a complimentary inverted "V" shape which slideably mates therewith in use.

8. A window frame system for containing window sash systems as in claim 7 in which said arrow head shape is an aluminum insert.

9. A window frame system for containing window sash systems as in claim 7 in which said arrow head shape is an integral part of the window frame.

10. A window frame system for containing window sash systems as in claim 1 in which the deeper sides of said first and second upper window sash system guide means in said at least one of said inner and outer window frames are arcuate shaped as viewed in side cross-sectional elevation, such that when a window sash system with an arcuate shaped upper edge placed thereinto, is positioned beneath a deeper upper window sash system guide means, said window sash system can be lifted upward into said deeper window sash system guide means so that a lower edge of said window sash system is removed from a corresponding lower window sash system guide means, and such that when said window sash system is then rotated about a longitudinal axis defined by the horizontally upper edge of said window sash system within said deeper upper window sash system guide means, removal of said window sash system from said window frame can be achieved.

11. A window frame system for containing window sash systems as in claim 1 in which each of the inner and outer window frames is of single piece construction and is formed by resin transfer molding.

12. A window frame system for containing window sash systems as in claim 1 in which the inner window frame further comprises trim extending therefrom such that when said inner window frame is mounted to a building wall and viewed from the inside of the building, said trim extends over a portion of an inside wall in directions surrounding said inner window frame selected from the group consisting of right and left horizontal and up and down vertical.

13. A window frame system for containing window sash systems as in claim 1 in which the outer window frame further comprises trim extending therefrom such that when said outer window frame is mounted to a building wall and viewed from the outside of the building, said trim extends over a portion of said outside wall in directions surrounding said outer window frame selected from the group consisting of right and left horizontal and up and down vertical.

14. A window frame system as in claim 1, in which first and second window sash systems mounted therein are of essentially the same overall size, and in which present first and a second lower window sash system guide means extending essentially the horizontally oriented length of an upward facing surface of the said at least one generally horizontally oriented bottom sill are of different upward projecting lengths, each upward projecting length being appropriate to effect retention of present window sash systems between present first and a second lower window sash system guide means and, respectively, present shallower first and a second upper window sash system guide means which extend essentially the horizontally oriented length of a downward facing surface of said horizontally oriented top heads.

15. A window frame for use in containing window sash systems, said window frame, as viewed in frontal elevation, comprising:

vertically oriented right and left jambs;

a generally horizontally oriented bottom sill; and a horizontally oriented top head;

each of said vertically oriented right and left jambs having a lower portion at a vertically lower extent thereof, and an upper portion at a vertically upper extent thereof;

each of said generally horizontally oriented bottom sill and said horizontally oriented top head having a horizontally oriented length with a right portion at a right horizontal extent thereof and a left portion at a left horizontal extent thereof; with said horizontally oriented top head horizontally oriented length having one horizontally oriented side on a selection from the group consisting of to the right and to the left of an essential center point of said horizontally oriented length thereof, and an opposite horizontally oriented side respectively selected from the group consisting of to the left and to the right of said essential center point of said horizontally oriented length thereof;

wherein the right and left portions of said generally horizontally oriented bottom sill and of said horizontally oriented top head are continuous with said vertically oriented right and left jambs at the lower and upper portions of said right and left jambs, respectively;

wherein the generally horizontally oriented bottom sill of said window frame has an upward facing surface and wherein the horizontally oriented top head of said window frame has a downward facing surface, and wherein said upward facing surface of said generally horizontally oriented bottom sill directly faces the downward facing surface of said horizontally oriented top head;

said generally horizontally oriented bottom sill having first and second lower window sash system guide means extending essentially the entire horizontally oriented length of said upward facing surface thereof, and said horizontally oriented top head having first and second upper window sash system guide means extending essentially the entire horizontally oriented length of said downward facing surface thereof, each of said first and second upper window sash system guide means extending upward into said downward facing surface of said horizontally oriented top head to first and second depths, with a change in said depth occurring approximately half-way along the horizontally oriented length of said horizontally oriented top head, with said first upper window sash system guide means being shallower than the second on one horizontally oriented side, and with said second upper window sash system guide means being shallower than said first upper window sash system guide means on the opposite horizontally oriented side;

such that in use a first window sash system can be horizontally slideably retained within said generally horizontally oriented bottom sill and said horizontally oriented top head corresponding first window sash system guide means in said window frame, and such that simultaneously a second window sash system can be horizontally slideably retained within said generally horizontally oriented bottom sill and said horizontally oriented top head corresponding second window sash system guide means in said window frame;

such that said window frame can be affixed to a building wall and first and second window sash systems placed within said corresponding horizontally oriented first upper and first lower, and second upper and second lower window sash system guide means respectively, so that each of said first and second window sash systems can be placed in a closed window sash system position wherein each of said first and second window sash systems can be positioned below the shallower side of one of the horizontally oriented top head contained upper window sash system guide means, such that said first and second window sash systems can not be pried upward, and such that each of said first and second window sash systems can slide horizontally so as to be placed in an open position beneath one of the deeper upper horizontally oriented top head contained window sash system guide means.

16. A window frame as in claim 15, in which the vertically oriented jamb adjacent to at least one of the shallower horizontally oriented top head contained upper window sash system guide means has therein:

window sash system edge receiving means, such than when a window sash system in said window frame is placed in the closed window sash system position, an edge of said window sash system adjacent to said window sash system edge receiving means can be received in said window sash system edge receiving means, simultaneous with an upper edge of said window sash system being adapted to being received within said shallower side of the horizontally oriented top head contained upper window sash system guide means.

17. A window frame as in claim 16, in which a ridge projects from a centrally facing surface in said window sash system edge receiving means, said ridge being comprised of a material which is adapted to provide insulating contact between said window sash system edge receiving means and the window sash system contained edge.

18. A window frame as in claim 15, in which the shallower side of the upper window sash system guide means is located on the right side thereof, as said window frame is viewed in frontal elevation when said window frame is mounted in a wall of said building.

19. A window frame as in claim 15, in which the shallower side of the upper window sash system guide means is located on the left side thereof, as said window frame is viewed in frontal elevation when said window frame is mounted in a wall of said building.

20. A window frame as in claim 15, in which the first and second lower window sash system guide means are arrowhead shaped and lower edges window sash systems placed into said first and second window sash system guide means have a complimentary inverted "V" shape which slideably mates therewith in use.

21. A window frame as in claim 20, in which said arrow head shape is an aluminum insert.

22. A window frame as in claim 20, in which said arrow head shape is an integral part of the window frame.

23. A window frame as in claim 15, in which the deeper sides of said first and second upper window sash system guide means are arcuate shaped as viewed in side cross-sectional elevation, such that when a window sash system with an arcuate shaped upper edge placed thereinto, is positioned beneath a deeper upper window sash system guide means, said window sash system can be lifted upward into said deeper window sash system guide means so that a lower edge of said window sash system is removed from a corresponding lower window sash system guide means, and such that when said window sash system is then rotated about a longitudinal axis defined by the horizontally upper edge of said window sash system within said deeper upper window sash system guide means, removal of said window sash system from said window frame can be achieved.

24. A window frame of as in claim 15, which is of single piece construction and is formed by resin transfer molding.

25. A window frame as in claim 15, which further comprises trim extending therefrom such that when said window frame is mounted to a building wall and viewed in frontal elevation, said trim extends over a portion of the wall in directions surrounding said inner window frame selected from the group consisting of right and left horizontal and up and down vertical.

26. A window frame as in claim 15, which further comprises locking means for securing window sash systems in a closed window sash system position.

27. A window Frame as in claim 15, in which said generally horizontally oriented bottom sill presents with a downward slope as viewed in side elevation, such that when said window frame is mounted to an outside wall of the building, rain water falling thereonto will run off thereof away from said wall.

28. A window Frame as in claim 15, which further comprises screen receiving means.

29. A method of installing a window frame system for containing window sash systems, said method comprising the steps of:

a. providing a window frame system for containing window sash systems, said window frame system comprising:

inner and outer window frames;

each of said inner and outer window frames, as viewed in frontal elevation, comprising:

vertically oriented right and left lambs;

a generally horizontally oriented bottom sill; and a horizontally oriented top head;

each of said vertically oriented right and left iambs having a lower portion at a vertically lower extent thereof, and an upper portion at a vertically upper extent thereof;

each of said generally horizontally oriented bottom sill and said horizontally oriented top head having a horizontally oriented length with a right portion at a right horizontal extent thereof and a left portion at a left horizontal extent thereof; with said horizontally oriented top head horizontally oriented length having one horizontally oriented side on a selection from the group consisting of to the right and to the left of an essential center point of said horizontally oriented length thereof, and an opposite horizontally oriented side respectively selected from the group consisting of to the left and to the right of said essential center point of said horizontally oriented length thereof;

wherein, for each of said inner and outer window frames, the right and left portions of said generally horizontally oriented bottom sill and of said horizontally oriented top head are continuous with said vertically oriented right and left jambs at the lower and upper portions of said right and left jambs, respectively;

wherein the generally horizontally oriented bottom sill of said inner window frame has an upward facing surface and wherein the horizontally oriented top head of said inner window frame has a downward facing surface; and wherein the generally horizontally oriented bottom sill of said outer window frame has an upward facing surface and wherein the horizontally oriented top head of said outer window frame has a downward facing surface;

and wherein, for each of said inner and outer window frames, the upward facing surface of the generally horizontally oriented bottom sill thereof directly faces the downward facing surface of the horizontally oriented top head thereof;

10 said inner and outer window frames being of similar sizes and shapes;

at least one of said inner and outer window frames having first and second lower window sash system guide means extending essentially the entire horizontally oriented length of the upward facing surface of the generally horizontally oriented bottom sill thereof, and said horizontally oriented top head of said at least one of said inner and outer window frames having first and second upper window sash system guide means extending essentially the entire horizontally oriented length of the downward facing surface thereof, each of said first and second upper window sash system guide means extending upward into said downward facing surface of said horizontally oriented top head of said at least one of said inner and outer window frames to first and second depths, with a change in said depth occurring approximately half-way along the horizontally oriented length of said horizontally oriented top head in said at least one of said inner and outer window frames, with said first upper window sash system guide means being shallower than the second on one horizontally oriented side, and with said second upper window sash system guide means being shallower than said first upper window sash system guide means on the opposite horizontally oriented side;

such that in use a first window sash system can be horizontally slideably retained within said generally horizontally oriented bottom sill and said horizontally oriented top head corresponding first window sash system guide means in said at least one of the inner and outer window frames, and such that simultaneously a second window sash system can be horizontally slideably retained within said generally horizontally oriented bottom sill and said horizontally oriented top head corresponding second window sash system guide means in said at least one of the inner and outer window frames;

such that said inner and outer window frames can be affixed to a building wall and first and second window sash systems placed within said at least one of said inner and outer window frames, between corresponding horizontally oriented first upper and first lower, and second upper and second lower window sash system guide means respectively, so that each of said first and second window sash systems can be placed in a closed window sash system position wherein each of said first and second window sash systems can be positioned below the shallower side of one of the horizontally oriented top head contained upper window sash system guide means, such that said first and second window sash systems can not be pried upward, and such that each of said first and second window sash systems can slide horizontally so as to be placed in an open position beneath the deeper side of one of the upper horizontally oriented top head contained window sash system guide means;

each of said inner and outer window frames optionally further comprising trim extending therefrom such that when said window frame is mounted to a building wall and viewed in frontal elevation, said trim extends over a portion of said wall in directions surrounding said inner window frame selected from the group consisting of right and left horizontally and up and down vertically;

b. mounting one window frame selected from the group consisting of said outer window frame and said inner window frame to, respectively, a selection from the group consisting of the outside and inside wall of a building;

c. causing foam insulation to be entered around said installed window frame inside said wall; and d. installing the remaining as yet uninstalled window frame;

such that said foam insulation contacts both said inner and outer window frames inside said wall and serves to help secure them in position in addition to effecting insulation.

* * * * *